US007425060B2

(12) United States Patent
Kitahara et al.

(10) Patent No.: US 7,425,060 B2
(45) Date of Patent: Sep. 16, 2008

(54) SEALING MECHANISM OF INK CHANNEL

(75) Inventors: Toshihiro Kitahara, Tachikawa (JP); Hiroshi Hashi, Tokyo (JP)

(73) Assignee: Olympus Corporation, Tokyo (JP)

( * ) Notice: Subject to any disclaimer, the term of this patent is extended or adjusted under 35 U.S.C. 154(b) by 353 days.

(21) Appl. No.: 10/946,518

(22) Filed: Sep. 20, 2004

(65) Prior Publication Data

US 2005/0062810 A1 Mar. 24, 2005

(30) Foreign Application Priority Data

Sep. 24, 2003 (JP) ..... 2003-332130

(51) Int. Cl.
*B41J 2/175* (2006.01)
*B41J 2/19* (2006.01)

(52) U.S. Cl. ..... 347/85; 347/92

(58) Field of Classification Search ..... 347/84–86, 347/92; 251/148, 149

See application file for complete search history.

(56) References Cited

U.S. PATENT DOCUMENTS 6,520,630 B1 * 2/2003 Oda et al. ..... 347/85
6,866,372 B2 * 3/2005 Oda et al. ..... 347/85
6,969,161 B2 * 11/2005 Kuwabara et al. ..... 347/85
7,198,351 B2 * 4/2007 Wang et al. ..... 347/28

FOREIGN PATENT DOCUMENTS

JP 2000-103074 A 4/2000
JP 2000-103084 A 4/2000

* cited by examiner

*Primary Examiner*—Stephen D Meier
*Assistant Examiner*—Geoffrey Mruk
(74) *Attorney, Agent, or Firm*—Frishauf, Holtz, Goodman & Chick, P.C.

(57) ABSTRACT

There is disposed a sealing mechanism having a container which stores an ink liquid; an ink head which spouts the ink liquid; and an ink channel switching section which is disposed in an ink channel connecting the container to the ink head and which switches the ink channel to a sealed state or an opened state, wherein the ink liquid flowing into the ink head from the container is quickly replaced with air (bubble) flowing through the container from the ink head during the switching of the ink channel to the opened state from the sealing state.

24 Claims, 5 Drawing Sheets

FIG. 5A
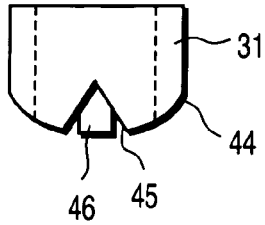
FIG. 5B
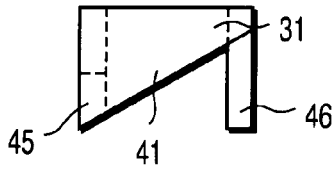
FIG. 5C
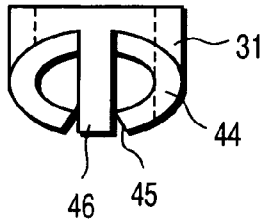
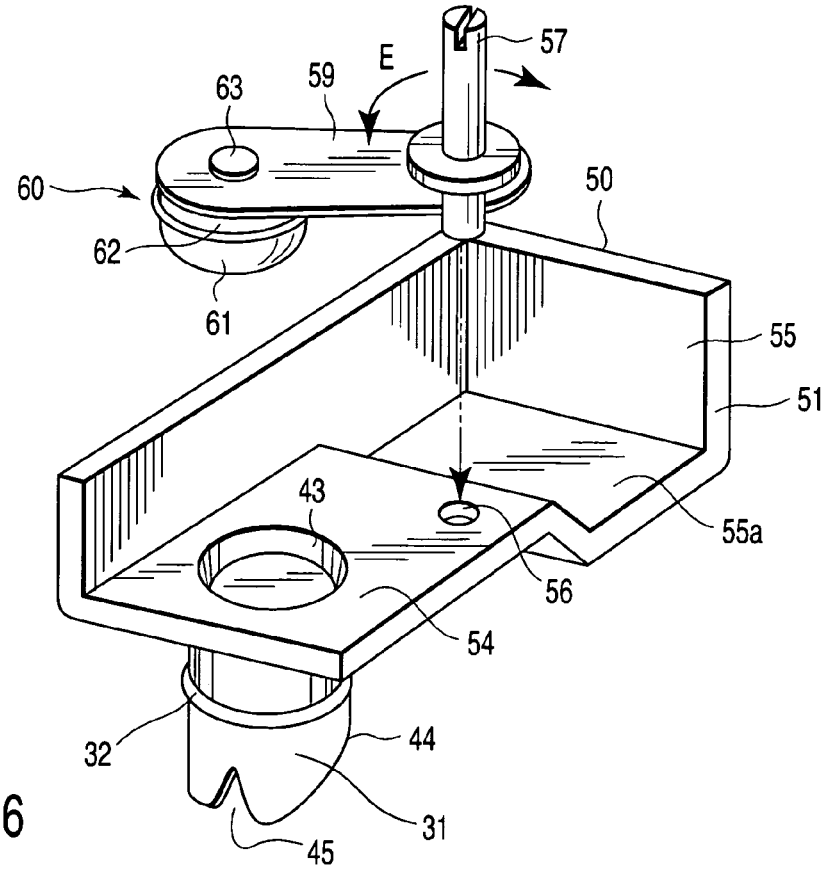
FIG. 6

SEALING MECHANISM OF INK CHANNEL

CROSS-REFERENCE TO RELATED APPLICATIONS

This application is based upon and claims the benefit of priority from prior Japanese Patent Application No. 2003-332130, filed Sep. 24, 2003, the entire contents of which are incorporated herein by reference.

BACKGROUND OF THE INVENTION

1. Field of the Invention

The present invention relates to an image forming apparatus, for example, of an ink jet system, and a sealing mechanism of an ink channel, which is disposed in an ink channel to supply an ink liquid stored in a container to an ink head and which seals the ink channel, for example, at the time of a replacing operation of the ink head.

2. Description of the Background Art

In an image forming apparatus of an ink jet system, an ink liquid stored in an ink tank is supplied to an ink head, and the ink liquid is spouted from the ink head. The spouted ink liquid is shot onto an image forming medium. Accordingly, an image is formed on the image forming medium.

A method of supplying the ink liquid to the ink head from the ink tank is described, for example, in Jpn. Pat. Appln. KOKAI Publication No. 2000-103084. In the Jpn. Pat. Appln. KOKAI Publication No. 2000-103084, at the time of an image forming operation, a pump for circulating ink is driven to thereby supply the ink liquid stored in the ink tank to the ink head. When air is mixed in the ink liquid in spouting the ink liquid from the ink head, a trouble is caused in the spout of the ink liquid by the ink head. A method of removing the air in the ink liquid in this situation has been described.

To remove the air in the ink liquid, the air included in the ink liquid is floated upwards utilizing buoyancy of the air, and captured. That is, the air included in the ink liquid is trapped in a vertical portion of a bypass pipe through a spatial portion above the ink head. During forced circulation of the ink liquid, an opening/closing valve disposed on the bypass pipe is opened, and the pump for circulating the ink is driven. Accordingly, the ink liquid returns to the ink tank through the bypass pipe. Accordingly, the air is blown into the ink tank. The air is separated from the ink liquid in the ink tank.

BRIEF SUMMARY OF THE INVENTION

According to a major aspect of the present invention, there is provided a sealing mechanism of an ink channel, comprising: at least one ink head which spouts an ink liquid; a container which stores at least the ink liquid; an ink channel which supplies at least the ink liquid into the ink head from the container; an ink channel switching section which is disposed in the ink channel and which opens or seals the ink channel; an ink inflow section disposed on an upstream side of the ink channel switching section in the ink channel; and an ink outflow section disposed on a downstream side of the ink channel switching section in the ink channel; wherein the ink channel switching section quickly performs replacement of feeding the air and the ink liquid; the air which is one or both of insides of the ink channel and the ink head to the upstream side of the ink channel and feeding the ink liquid to the downstream side of the ink channel, when the ink channel is opened.

BRIEF DESCRIPTION OF THE SEVERAL VIEWS OF THE DRAWING

FIG. 5A is a front constitution diagram of a cutout portion and a hanging portion formed in an outflow port of an ink outflow channel in the sealing mechanism of the ink channel;

FIG. 5B is a side surface constitution diagram of the cutout portion and the hanging portion;

FIG. 5C is a back surface constitution diagram of the cutout portion and the hanging portion;

FIG. 6 is an exploded constitution diagram showing a second embodiment of the sealing mechanism of the ink channel according to the present invention;

DETAILED DESCRIPTION OF THE INVENTION

A first embodiment of the present invention will be described hereinafter with reference to the drawings.

Figure 1:
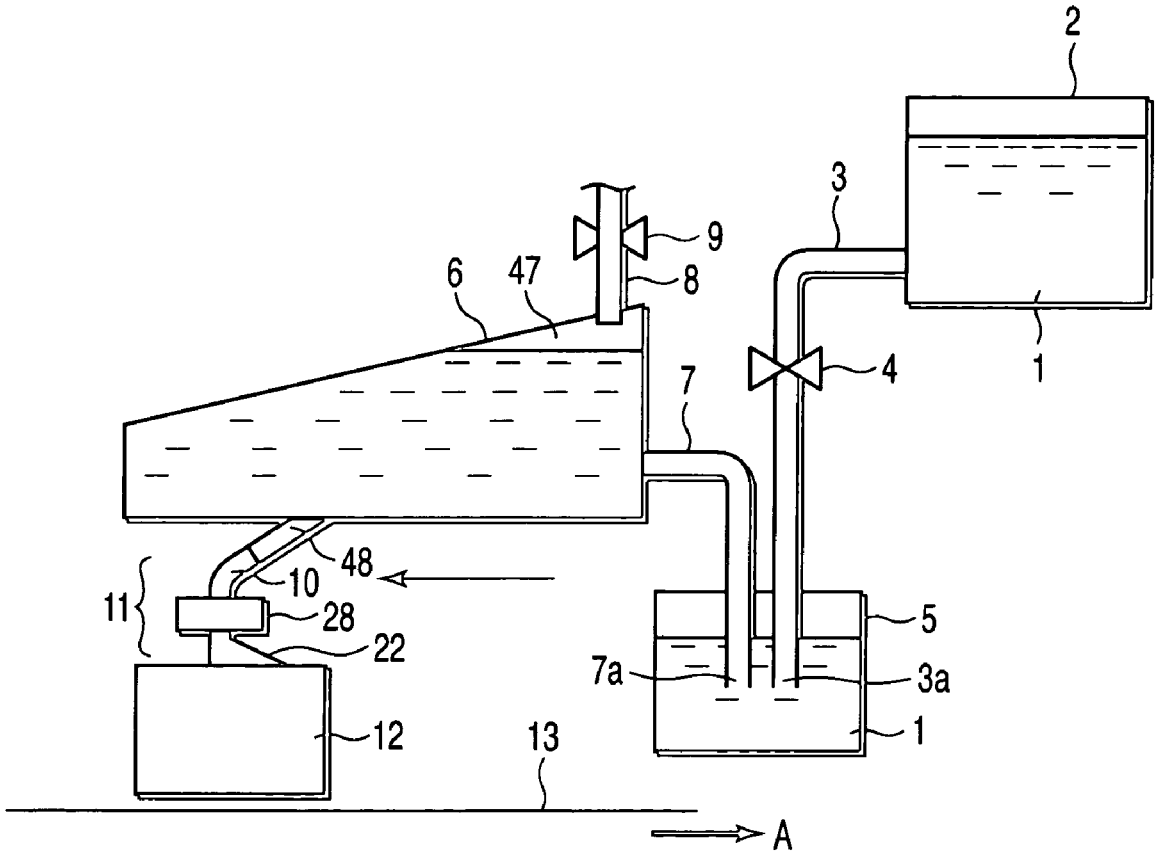
FIG. 1 is a whole constitution diagram showing an ink channel of an image forming apparatus of an ink jet system, which a sealing mechanism of the ink channel of the image forming apparatus according to the present invention is applied.

FIG. 1 is a whole constitution diagram showing an ink channel of an image forming apparatus of an ink jet system, to which a sealing mechanism of the ink channel is applied. The image forming apparatus of the ink jet system has a plurality of ink tanks 2 which store ink liquids 1 of colors of black (K), cyan (C), magenta (M), and yellow (Y). To avoid complexity in drawing, FIG. 1 shows only one ink path with respect to the ink liquid 1 of one color.

The ink tank 2 is connected to an ink path pipe 3. The ink path pipe 3 is curved halfway, and extended downwards. The ink path pipe 3 is provided with an opening/closing valve 4. A reservoir tank 5 is disposed below the ink tank 2. The reservoir tank 5 is sealed. A lower end port 3*a* of the ink path pipe 3 is extended into the reservoir tank 5.

Therefore, when the opening/closing valve 4 is opened, the ink liquid 1 in the ink tank 2 is supplied into the reservoir tank 5 through the ink path pipe 3 by a difference of elevation between the ink tank 2 and the reservoir tank 5.

A distribution unit 6 in the container which stores the ink liquid 1 is disposed in a height position between the ink tank 2 and the reservoir tank 5. The distribution unit 6 is connected to an ink path pipe 7. The ink path pipe 7 is curved halfway, and extended downwards. A suction port 7*a* of the ink path pipe 7 is extended into the reservoir tank 5. An atmosphere open tube 8 is disposed above the distribution unit 6. The atmosphere open tube 8 is provided with an atmosphere open valve 9.

Therefore, when the ink liquid 1 is supplied to the reservoir tank 5 from the ink tank 2 through the ink path pipe 3 in an opened state of the atmosphere open valve 9, a pressure in the reservoir tank 5 rises.

The ink liquid 1 in the reservoir tank 5 is supplied to the distribution unit 6 through the ink path pipe 7 by a pressure rise in the reservoir tank 5.

An ink head 12 of an ink jet system is disposed under and connected to the distribution unit 6 via a sealing mechanism 11 of an ink channel having a tubular ink inflow pipe 48, and a tubular ink inflow channel 10. The ink inflow channel 10 is formed of a resin. An image forming medium 13 is conveyed under the ink head 12 at a constant speed in an arrow A direction. The ink head 12 spouts the ink liquid 1. The ink liquid 1 spouted from the ink head 12 is shot on the image forming medium 13. Accordingly, an image is formed on the image forming medium 13.

Figure 2:
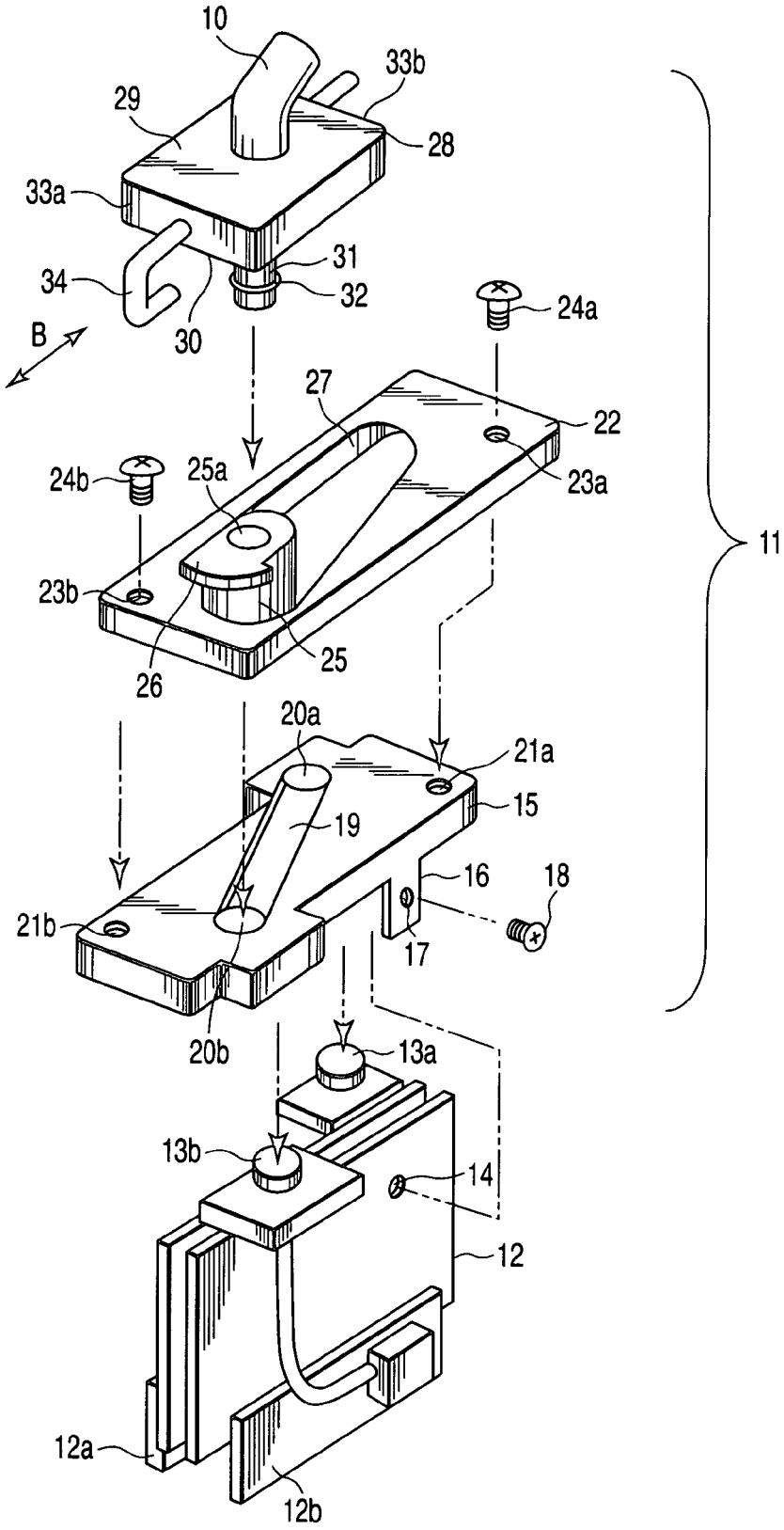
FIG. 2 is an exploded constitution diagram of the sealing mechanism and an ink head according to a first embodiment of the sealing mechanism of the ink channel of the present invention.

FIG. 2 shows an exploded constitution diagram of the sealing mechanism 11 of the ink channel and the ink head 12.

In the ink head 12, two ink head bodies 12*a*, 12*b* are disposed in parallel with each other. Each of the ink head bodies 12*a*, 12*b* has a plurality of nozzles which spout the ink liquid 1. Ink supply ports 13*a*, 13*b* are disposed above the respective ink head bodies 12*a*, 12*b*. A screw hole 14 is disposed in the side surface of the ink head 12.

A chamber base member 15 is attached to an upper part of the ink head 12. An attachment plate 16 is directed downwards and disposed on an edge of the chamber base member 15. A hole 17 is disposed in the attachment plate 16. A screw 18 is fitted in the screw hole 14 through the hole 17 to thereby fix the chamber base member 15 to the upper part of the ink head 12.

An ink circulation groove 19 is disposed in the upper surface of the chamber base member 15. Ink supply holes 20*a*, 20*b* are disposed in opposite end portions of the ink circulation groove 19. Positions in which the respective ink supply holes 20*a*, 20*b* correspond to the ink supply ports 13*a*, 13*b*. Screw holes 21*a*, 21*b* are disposed in corner portions of the chamber base member 15.

An oblique chamber 22 in an introducing portion of the ink liquid 1 is attached to the upper part of the chamber base member 15. The oblique chamber 22 is formed of a resin. Holes 23*a*, 23*b* are disposed in corner portions of the oblique chamber 22. Screws 24*a*, 24*b* are fitted into the respective screw holes 21*a*, 21*b* of the chamber base member 15 through holes 23*a*, 23*b* to thereby fix the oblique chamber 22 onto the chamber base member 15.

A cylindrical attachment port 25 is disposed on the upper surface of the oblique chamber 22. A plate-piece-shaped engaging plate 26 is protruded and disposed on an edge of an opening 25*a* of the attachment port 25.

A tilt face 27 for introducing air (bubbles) is disposed on the upper surface of the oblique chamber 22. The tilt face 27 is formed of a resin. The tilt face 27 tilts along an ascending gradient direction toward the opening 25*a* of the attachment port 25. At an upper portion of the gradient tilt of the tilt face 27 is matched with that of tilt of an outflow port 44 of an ink outflow channel 31 in an ink outflow part. The tilt face 27 guides the air rising from an ink head 12 side into the ink outflow channel 31 along the tilt of the ascending gradient.

The oblique chamber 22 quickly replaces the ink liquid 1 flowing downwards from the outflow port 44 of the ink outflow channel 31 with the air flowing backwards above the ink head 12 side. The ink liquid 1 is quickly replaced with the air because the air flowing backwards to an upward direction along the tilt face 27 of the oblique chamber 22 permeates from the upper portion of the tilt in the outflow port 44 having the tilt, and flows upwards. Here, the replacement means a phenomenon in which the ink liquid 1 flowing downwards and the air flowing backwards to the upward direction mutually move smoothly.

A switching housing 28 in an ink channel switching section is attached to the upper surface of the oblique chamber 22. The switching housing 28 is formed of a resin into a sealed structure. The ink inflow channel 10 in an ink inflow section is disposed on an upper surface 29 of the switching housing 28. The ink inflow channel 10 is tilted toward the distribution unit 6 from the upper surface of the switching housing 28 along a direction of an ascending gradient.

By the tilt formed on the ink inflow channel 10 along the direction of the ascending gradient toward the distribution unit 6, the ink liquid 1 flowing downwards from the distribution unit 6 through the ink inflow pipe 48 is quickly replaced with the air flowing backwards to the upward direction from an ink inflow port 41. The ink liquid 1 is quickly replaced with the air because the air flows backwards to the upward direction along the upper portion in the tilt in the tubular ink inflow channel 10.

The tubular ink outflow channel 31 is disposed in a lower surface 30 of the switching housing 28. The ink outflow channel 31 is formed of a resin. The ink outflow channel 31 is disposed in a vertically downward direction with respect to the lower surface 30 of the switching housing 28. The ink outflow channel 31 and ink inflow channel 10 disposed in the switching housing 28 are disposed in mutually facing positions. The ink outflow channel 31 is inserted into the attachment port 25 on the upper surface of the oblique chamber 22. An O-ring 32 is disposed on the outer peripheral surface of the ink outflow channel 31. The O-ring 32 seals between the ink outflow channel 31 and the attachment port 25.

A switching lever 34 is disposed slidably in an arrow B direction between mutually facing side surfaces 33*a*, 33*b* of the switching housing 28. The switching lever 34 is disposed in such a manner as to perform a switching operation in sealing or opening the ink channel.

Figure 3:
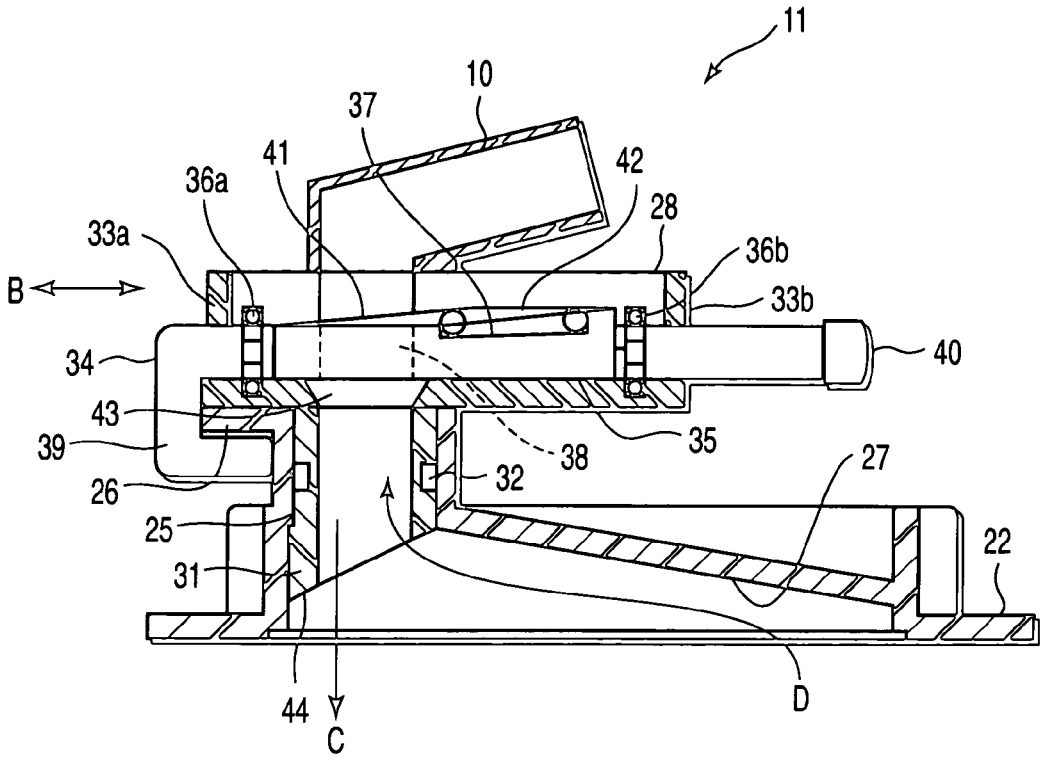
FIG. 3 is a constitution diagram showing an opened state of the sealing mechanism of the ink channel according to the first embodiment.
Figure 4:
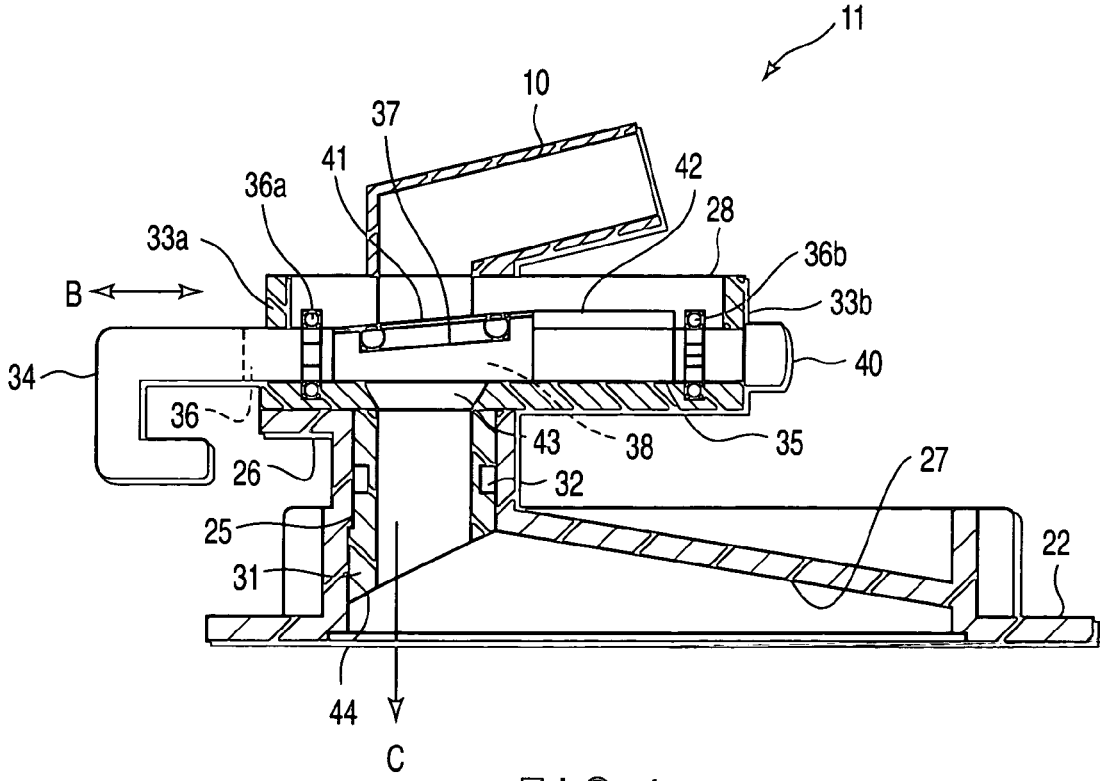
FIG. 4 is a constitution diagram showing a sealed state of the sealing mechanism of the ink channel according to the first embodiment.

FIGS. 3 and 4 show constitution diagrams of the sealing mechanism 11 of the ink channel in the first embodiment of the present invention. FIG. 3 shows a state in which the ink channel is opened. FIG. 4 shows a state in which the ink channel is sealed.

A slide hole 35 is disposed in the switching housing 28. Sealing members 36*a* and 36*b* are disposed in opposite end portions of the slide hole 35. The respective sealing members 36*a*, 36*b* support the switching lever 34, and seals with respect to the switching lever 34. The switching lever 34 slides the slide hole 35 in the arrow B direction in a state in which the lever is supported by the sealing members 36*a*, 36*b*.

The switching lever 34 is provided with an ink sealing plug 37 and an open port 38. The ink sealing plug 37 is constituted of a sealing member. The ink sealing plug 37 seals between the ink inflow channel 10 and the ink outflow channel 31 which are ink channels. The open port 38 is constituted of a hole. The open port 38 opens (communicating) between the ink inflow channel 10 and the ink outflow channel 31.

A hook-shaped portion 39 is formed on one of opposite sides of the switching lever 34. A slide stopping portion 40 is disposed on the other side of the switching lever 34. The hook-shaped portion 39 abuts on the engaging plate 26 disposed on the edge of the attachment port 25 of the oblique chamber 22 to engage with the switching lever 34. Accordingly, the hook-shaped portion 39 of the switching lever 34 positions the open port 38 in the slide hole 35 between the ink inflow channel 10 and the ink outflow channel 31.

When the hook-shaped portion 39 abuts on the engaging plate 26 disposed on the edge of the attachment port 25 of the oblique chamber 22, it is impossible to detach the ink outflow channel 31 from the attachment port 25 of the oblique chamber 22. Therefore, the ink head 12 is prevented from being detached from the ink outflow channel 31 by mistake in an opened state between the ink inflow channel 10 and the ink outflow channel 31.

The slide stopping portion 40 abuts on the side surface 33*b* of the switching housing 28 to engage with the switching lever 34. Accordingly, the slide stopping portion 40 of the switching lever 34 positions the ink sealing plug 37 between the ink inflow channel 10 and the ink outflow channel 31.

It is to be noted that the ink sealing plug 37 and the open port 38 may be positioned using another mechanism.

The ink inflow port 41 which communicates with the ink inflow channel 10 is disposed in the upper surface of the slide hole 35. The ink inflow port 41 has an opening which tilts with respect to a direction of the ink liquid 1 flowing toward the ink outflow channel 31 from the ink inflow channel 10.

The ink sealing plug 37 adheres to the tilting ink inflow port 41 in the form of a wedge. Accordingly, the ink is securely sealed with respect to the ink inflow port 41. The ink inflow port 41 is formed into an elliptic shape. Accordingly, a surface tension in the ink inflow port 41 is non-uniform, and films of bubbles by air are not formed in the ink inflow port 41. Therefore, the ink liquid 1 flowing downwards from the ink inflow channel 10 is instantly replaced with the air flowing backwards to the upward direction from an ink outflow port 43.

A relief space 42 is disposed adjacent to the ink inflow port 41. The relief space 42 continues from an uppermost portion of the tilting ink inflow port 41, and extends in a horizontal direction. The ink sealing plug 37 is disposed in the relief space 42 in a communication place in which the open port 38 faces the ink outflow channel 31 in the relief space 42.

The ink outflow port 43 communicating with the ink outflow channel 31 is disposed in a lower surface of the slide hole 35. The ink outflow port 43 is formed in such a manner that a diameter of the port gradually decreases downwards, and upper and lower portions of the ink outflow port 43 have tilts.

Since the ink outflow port 43 is formed in such a manner as to taper downwards, the ink liquid 1 flowing downwards from the ink inflow port 41 is quickly replaced with the air flowing backwards to the upward direction from the outflow port 44 of the ink outflow channel 31. The ink liquid 1 is quickly replaced with the air, because the air flows upwards along the tilt of the ink outflow port 43, and thereafter flows backwards to the upward direction.

The outflow port 44 of the ink outflow channel 31 in the ink outflow section has an opening which tilts with respect to a flow direction of the ink liquid 1 flowing toward the ink head 12 from the ink outflow channel 31. The ink outflow channel 31 is formed into a tubular shape.

Therefore, the opening of the outflow port 44 is formed into an elliptic shape.

Since the surface tension in the opening becomes non-uniform, and the films of the bubbles are not formed in the opening, the opening of the outflow port 44 formed into the elliptic shape quickly replaces the ink liquid 1 flowing downwards from the outflow port 44 with the air flowing backwards to the upward direction from the oblique chamber 22 in the introducing section of the ink liquid 1.

A cutout portion 45 and hanging portion 46 shown in FIGS. 5A to 5C may be additionally formed with respect to the opening of the outflow port 44, formed into the elliptic shape, in the ink outflow channel 31. FIG. 5A is a front view, FIG. 5B is a side view, and FIG. 5C is a back view.

The cutout portion 45 and hanging portion 46 are disposed in mutually facing position in the outflow port 44.

The cutout portion 45 and hanging portion 46 quickly replace a downward flow C of the ink liquid 1 from the outflow port 44 shown in FIG. 3 with a flow D of the air flowing backwards to the upward direction from the ink head 12 side along the tilt face 27 of the oblique chamber 22 in the introducing section of the ink liquid 1. To replace the flow C of the ink liquid 1 with the flow D of the air, the cutout portion 45 and hanging portion 46 are additionally formed with respect to the opening of the outflow port 44, formed into the elliptic shape. Accordingly, the surface tension in the outflow port 44 becomes further non-uniform, and any film of bubbles by the air is not formed in the opening.

Next, an operation of the sealing mechanism 11 of the ink channel constituted as described above will be described.

At the time of the image forming operation of the image forming apparatus, as shown in FIG. 3, the switching lever 34 is pressed in the switching housing 28 on a hook-shaped portion 39 side. The hook-shaped portion 39 of the switching lever 34 abuts on the engaging plate 26 disposed on the edge of the attachment port 25 of the oblique chamber 22 to position the open port 38 between the ink inflow channel 10 and the ink outflow channel 31. Accordingly, an opened (communicating) state is achieved between the ink inflow channel 10 and the ink outflow channel 31.

As shown in FIG. 1, when the opening/closing valve 4 is opened, the ink liquid 1 stored in the ink tank 2 is supplied into the reservoir tank 5 through the ink path pipe 3. A pressure in the reservoir tank 5 rises by the supply of the ink liquid 1. By the pressure rise in the reservoir tank 5, the ink liquid 1 in the reservoir tank 5 is supplied to the distribution unit 6 through the ink path pipe 7.

At this time, the atmosphere open valve 9 disposed above the distribution unit 6 is open to the atmosphere.

The ink liquid 1 which has flowed out of the distribution unit 6 is instreaming into the sealing mechanism 11 through the ink inflow pipe 48 and ink inflow channel 10. The ink liquid 1 is supplied into the ink head 12 through the ink outflow channel 31 in the sealing mechanism 11.

The ink head 12 spouts the supplied ink liquid 1. The image forming medium 13 is conveyed under the ink head 12. Therefore, the ink liquid 1 is shot onto the image forming medium 13 to thereby form the image.

At this time, when the ink head 12 shoots the ink liquid 1 mixed with bubbles onto the image forming medium 13, the image formation is not performed in a desired manner.

Therefore, the sealing mechanism 11 prevents the ink liquid 1 into which the air (bubble) is mixed from being supplied to the ink head 12 in a supply process of the ink liquid 1 into the ink head 12 through the distribution unit 6 and sealing mechanism 11 in the ink channel. That is, the sealing mechanism 11 quickly passes backwards and replaces the air (bubbles) in advance without any accumulation on an upstream side of the ink channel.

Next, a case will be described where the sealing mechanism 11 once seals the ink channel, and opens the ink channel again, for example, after performing a changing operation of the ink head 12.

As shown in FIG. 4, the switching lever 34 of the sealing mechanism 11 is pressed in the switching housing 28 on a slide stopping portion 40 side. The slide stopping portion 40 of the switching lever 34 abuts on the side surface 33*b* of the switching housing 28 to position the ink sealing plug 37 between the ink inflow channel 10 and the ink outflow channel 31. Accordingly, the ink sealing plug 37 adheres and is sealed with respect to the ink inflow port 41. Accordingly, a sealed state is achieved between the ink inflow channel 10 and the ink outflow channel 31.

In this state, as shown in FIG. 2, the ink outflow channel 31 in the switching housing 28 is disconnected from the attachment port 25 in the oblique chamber 22. When the ink outflow channel 31 is disconnected from the attachment port 25, the ink inflow port 41 is sealed by the ink sealing plug 37, and therefore the ink liquid 1 does not fly/scatter from the ink outflow channel 31.

After changing the ink head 12, the ink outflow channel 31 in the switching housing 28 is fitted/inserted into the attachment port 25 in the oblique chamber 22.

As shown in FIG. 3, the hook-shaped portion 39 side in the switching lever 34 of the sealing mechanism 11 is pushed into the switching housing 28. Accordingly, the ink liquid 1 flows toward the ink head 12 in an arrow C direction from the ink inflow pipe 48 under the distribution unit 6 through the ink inflow channel 10 in the sealing mechanism 11 of the ink channel, the ink inflow port 41, the open port 38, the ink outflow port 43, the ink outflow channel 31, and the outflow port 44.

On the other hand, the air (bubble) in the ink head 12 flows in an arrow D direction, rises along the tilt face 27 in the oblique chamber 22, and flows upwards from the outflow port 44.

In this manner, according to the first embodiment, the sealing mechanism 11 of the ink channel which quickly passes backwards and replaces the air (bubble) from the ink head 12 into the distribution unit 6 on the upstream side from the downstream side of the flow of the ink liquid 1 is disposed in the ink channel between the distribution unit 6 in the container which stores the ink liquid 1, and the ink head 12.

Accordingly, the ink liquid 1 can be smoothly passed into the ink head 12 from the distribution unit 6 side in the container, and the air (bubble) rising from the ink head 12 side can be smoothly passed into a portion 47 above a liquid level of the distribution unit 6 without any accumulation.

Therefore, the sealing mechanism 11 of the ink channel can quickly secure the ink channel in which any air (bubble) is not mixed even in a case where the once sealed ink channel is opened again.

Next, a second embodiment of the present invention will be described with reference to the drawing. It is to be noted that the same parts as those in FIGS. 3 and 4 are denoted with the same reference numerals, and detailed description thereof is omitted.

Figure 7:
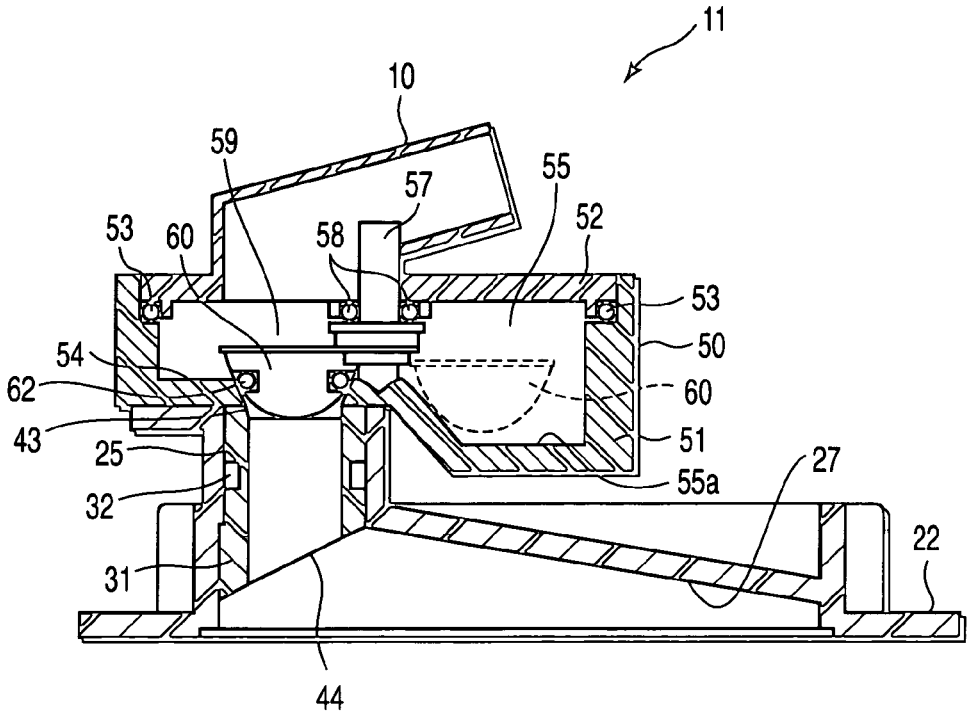
FIG. 7 is a sectional view of the sealing mechanism of the ink channel of the second embodiment.
Figure 8:
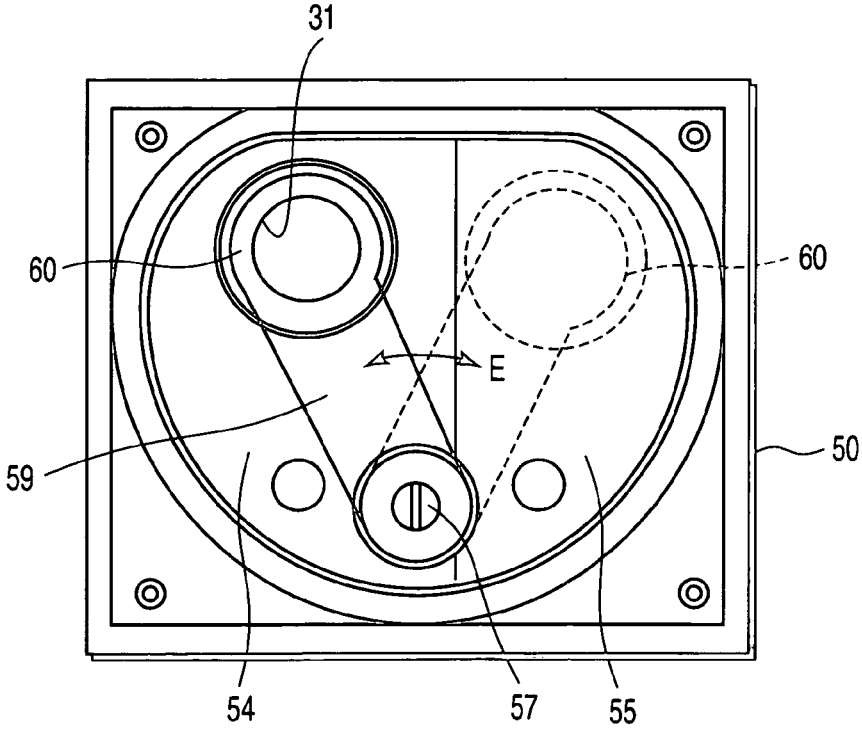
FIG. 8 is a plan view of the sealing mechanism of the ink channel of the second embodiment.

FIGS. 6 to 8 show constitution diagrams of a sealing mechanism 11 of an ink channel in the second embodiment of the present invention. FIG. 6 shows an exploded constitution diagram. FIG. 7 shows a sectional view. FIG. 8 shows a plan view.

A switching housing 50 is constituted of a container portion 51 and a lid portion 52. The container portion 51 and lid portion 52 are sealed by a seal 53.

The container portion 51 has a flat portion 54 and a relief space portion 55.

The relief space portion 55 has a bottom portion 55*a* formed in a position deeper than a plane position of the flat portion 54.

In the flat portion 54, an ink outflow port 43 and a shaft hole 56 are disposed. An ink path switching shaft 57 is rotatably inserted in the shaft hole 56. The ink path switching shaft 57 passes through seals 58 and the lid portion 52, and is protruded to the outside of the switching housing 50.

One end portion of a rotary arm 59 is connected to the ink path switching shaft 57. The rotary arm 59 is formed of a leaf spring constituted of an elastic member.

A hemispherical ink sealing plug 60 is disposed on the lower surface of the other end portion of the rotary arm 59. The ink sealing plug 60 has a hemispherical plug body 61 formed of a resin, and an O-ring 62 which is a sealing member disposed on a spherical surface of the plug body 61.

In the hemispherical ink sealing plug 60, the hemispherical plug body 61 may be used as the sealing member without disposing the O-ring 62.

The ink sealing plug 60 is fixed to the upper surface of the rotary arm 59 via a fixing member 63.

A distance between center positions of the ink sealing plug 60 and the ink path switching shaft 57 is equal to that between center positions of the ink outflow port 43 and the shaft hole 56. Therefore, when the ink path switching shaft 57 rotates in an arrow E direction, the rotary arm 59 rotates in response to the rotation of the ink path switching shaft 57. Accordingly, the ink sealing plug 60 moves along a circular track centering on the ink path switching shaft 57. By the movement, the ink sealing plug 60 moves to the position of the ink outflow port 43 or the relief space portion 55.

That is, the ink channel is sealed or opened by a rotary mechanism.

The ink inflow channel 10 in an ink inflow section tilts along an ascending gradient direction toward a distribution unit 6 even in the sealing mechanism 11 of the ink channel in the second embodiment of the present invention. Accordingly, the ink liquid 1 flowing downwards from the distribution unit 6 through an ink inflow pipe 48 is quickly replaced with air flowing backwards to an upward direction from an ink inflow port 41. The ink liquid 1 is quickly replaced with the air because the air flows backwards to the upward direction along an upper portion in the tilt in a tubular ink inflow channel 10.

Since a lower part of the ink outflow port 43 is tapered, the ink liquid 1 flowing downwards from the ink inflow channel 10 is quickly replaced with the air flowing backwards to the upward direction from an outflow port 44 of an ink outflow channel 31. The ink liquid 1 is quickly replaced with the air, because the air flows upwards along the tilt of the ink outflow port 43, and thereafter flows backwards to the upward direction.

Since the outflow port 44 is formed into the elliptic shape, a surface tension in the outflow port 44 becomes non-uniform, and any film of bubbles in the air is not formed in the outflow port 44. Accordingly, the ink liquid 1 flowing downwards from the outflow port 44 is quickly replaced with the air flowing backwards to the upward direction from an oblique chamber 22.

A cutout portion 45 is disposed in an opening of the outflow port 44, formed into an elliptic shape, and any film of bubbles by the air is not formed in the outflow port 44. Accordingly, the ink liquid 1 flowing downwards from the outflow port 44 is quickly replaced with the air flowing backwards to the upward direction from the oblique chamber 22.

The oblique chamber 22 quickly replaces the ink liquid 1 flowing downwards from the outflow port 44 of the ink outflow channel 31 with the air flowing backwards to the upward direction from an ink head 12 side. The ink liquid 1 is quickly replaced with the air in such a manner that the air flowing backwards to the upward direction along the tilt face 27 of the oblique chamber 22 intruding from the upper portion of the tilt in the outflow port 44 having the tilt and flows upwards.

As shown in FIGS. 5A to 5C, a cutout portion 45 or a hanging portion 46 may be additionally formed in the outflow port 44 of the ink outflow channel 31 formed into the elliptic shape. When the cutout portion 45 and the hanging portion 46 are additionally formed, the surface tension in the outflow port 44 becomes further non-uniform. Accordingly, any film of bubbles in the outflow port 44 is not formed.

Next, an operation of the sealing mechanism 11 of the ink channel constituted as described above will be described.

At the time of an image forming operation of an image forming apparatus, as shown in FIG. 8, the ink path switching shaft 57 is rotated/operated clockwise in an arrow E direction. Accordingly, the ink sealing plug 60 moves in the relief space portion 55. Since the relief space portion 55 has the bottom portion 55*a* deeper than the plane position of the flat portion 54, the plug body 61 does not contact the bottom portion of the relief space portion 55. Accordingly, the plug body 61 is not deformed. Therefore, a sealing precision at a time when the plug body 61 is fitted into the ink outflow port 43 does not drop for a long time.

When the ink sealing plug 60 is disposed in the relief space portion 55, an opened state is achieved between the ink inflow channel 10 and the ink outflow channel 31. When the opening/closing valve 4 is opened in this state as shown in FIG. 1, the ink liquid 1 stored in the ink tank 2 flows into the sealing mechanism 11 through the ink path pipe 3, reservoir tank 5, ink path pipe 7, distribution unit 6, ink inflow pipe 48, and ink inflow channel 10, and is supplied to the ink head 12 through the ink outflow channel 31 and oblique chamber 22 in the sealing mechanism 11. The ink head 12 spouts the ink liquid 1 with respect to the conveyed image forming medium 13. The image forming medium 13 is conveyed under the ink head 12. Therefore, the ink liquid 1 is shot onto the image forming medium 13 to form the image.

At this time, when the ink liquid 1 mixed with the bubbles is shot onto the image forming medium 13, image formation is not performed in a desired manner.

Therefore, the sealing mechanism 11 prevents the ink liquid 1 into which the air (bubble) is mixed from being supplied to the ink head 12 in a supply process of the ink liquid 1 into the ink head 12 through the distribution unit 6 and sealing mechanism 11 in the ink channel. That is, the sealing mechanism 11 quickly passes backwards and replaces the air (bubbles) in advance without any accumulation on an upstream side of the ink channel.

Next, a case will be described where the sealing mechanism 11 once seals the ink channel, and opens the ink channel again, for example, after performing a changing operation of the ink head 12.

The ink path switching shaft 57 is rotated/operated counterclockwise in the arrow E direction. Accordingly, the ink sealing plug 60 is positioned in the ink outflow port 43. The rotary arm 59 presses the ink sealing plug 60 into the ink outflow port 43 by an elastic force by the leaf spring. The ink sealing plug 60 is engaged/inserted into the ink outflow port 43 to seal the ink outflow port 43. Accordingly, a sealed state is achieved between the ink inflow channel 10 and the ink outflow channel 31.

In this state, the ink outflow channel 31 is disconnected from the attachment port 25 in the oblique chamber 22. When the ink outflow channel 31 is disconnected from the attachment port 25, the ink sealing plug 60 is fitted/inserted in the ink outflow port 43, and therefore the ink liquid 1 does not fly/scatter from the ink outflow channel 31.

After changing the ink head 12, the ink outflow channel 31 in the container portion 51 is fitted/inserted into the attachment port 25 in the oblique chamber 22 again.

The ink path switching shaft 57 of the sealing mechanism 11 is rotated/operated clockwise in the arrow E direction. Accordingly, the ink channel of the sealing mechanism 11 is brought into the opened state. The ink liquid 1 flows toward the ink head 12 from the ink inflow pipe 48 under the distribution unit 6 through the ink inflow channel 10 in the sealing mechanism 11 of the ink channel, the ink outflow port 43, the outflow port 44, the ink outflow channel 31, and the outflow port 44.

Moreover, the air (bubble) in the ink head 12 rises along the tilt face 27 in the oblique chamber 22, and flows upwards from the outflow port 44.

In this manner, according to the second embodiment, the sealing mechanism 11 of the ink channel which quickly passes backwards and replaces the air (bubble) from the ink head 12 into the distribution unit 6 on the upstream side from the downstream side of the flow of the ink liquid 1 is disposed in the ink channel between the distribution unit 6 in the container which stores the ink liquid 1, and the ink head 12.

Accordingly, the ink liquid 1 can be smoothly is instreaming into the ink head 12 from the distribution unit 6 side in the container. The air (bubble) rising from the ink head 12 side can be smoothly passed into a portion 47 above a liquid level of the distribution unit 6 without any accumulation.

Therefore, the sealing mechanism 11 of the ink channel can quickly secure the ink channel in which any air (bubble) is not mixed even in a case where the once sealed ink channel is opened again.

The present invention is not limited to the above-described embodiments, and may be modified as follows.

For example, the switching of the sealing or the opening between the ink inflow channel 10 and the ink outflow channel 31 is performed by the slide mechanism or the rotary mechanism, but another switching system may be used.

The switching of the sealing or the opening may be automated.

Each of the cutout portion 45 and the hanging portion 46 formed in the outflow port 44 of the ink outflow channel 31 is not limited to one portion, and a plurality of portions may be formed.

The sealing mechanism 11 of the ink channel is disposed in the ink channel which supplies the ink liquid 1 into the ink head 12 from the distribution unit 6 through the ink inflow channel 10 and ink outflow channel 31. However, the present invention is not limited to this embodiment, and the mechanism may be disposed in another ink channel in the image forming apparatus of the ink jet system and may be applied as a sealing valve.

In any of the various apparatuses each having the ink channel which are inclusive of the image forming apparatus of the ink jet system, the mechanism may be disposed in the middle of the ink channel.

What is claimed is:

1. A sealing mechanism for an ink channel which connects a container storing an ink liquid and at least one ink head for spouting the ink liquid, said sealing mechanism comprising:

an ink channel switching section which is disposed in the ink channel and which opens and seals the ink channel;

an ink inflow section, tilted at an oblique angle along an ascending gradient direction with respect to the ink channel switching section, disposed on an upstream side of the ink channel switching section in the ink channel; and an introducing section, having a tilt surface formed at an oblique angle along an ascending gradient direction towards the ink channel switching section, disposed on a downstream side of the ink channel switching section in the ink channel;

wherein the ink channel switching section carries out a parallel process of introducing at least one of air inside the ink channel and air inside the ink head to the upstream side of the ink channel and sending the ink liquid to the ink head only by the action of gravity on the ink liquid in the container, when the ink channel is opened.

2. The sealing mechanism of the ink channel according to claim 1, wherein the introducing section is disposed on the downstream side of an ink outflow section.

3. The sealing mechanism of the ink channel according to claim 1, wherein the container has a distribution unit which distributes the ink liquid to the ink head.

4. A sealing mechanism for an ink channel which connects a container storing an ink liquid and at least one ink head for spouting the ink liquid, said sealing mechanism comprising:

an ink channel switching section which is disposed in the ink channel and which opens and seals the ink channel;

an ink inflow section, tilted at an oblique angle along an ascending gradient direction with respect to the ink channel switching section, disposed on an upstream side of the ink channel switching section in the ink channel;

an ink outflow section disposed on a downstream side of the ink channel switching section in the ink channel; and an introducing section, having a tilt surface formed at an oblique angle along an ascending gradient direction towards the ink outflow section, disposed on the downstream side of the ink outflow section in the ink channel;

wherein the ink inflow section carries out a parallel process of introducing the ink liquid from the container only by the action of gravity on the ink liquid in the container and introducing air from the downstream side of the ink inflow section in the ink channel into the container, when the ink channel switching section is opened, wherein the ink channel switching section carries out a parallel process of introducing the ink liquid from the ink inflow section and introducing air from the downstream side in the ink channel switching section into the ink channel switching section, when the ink channel switching section is opened;

wherein the ink outflow section carries out a parallel process of introducing the ink liquid from the ink channel switching section and introducing air from the downstream side in the ink outflow section into the ink channel switching section, when the ink channel switching section is opened; and wherein the introducing section carries out a parallel process of introducing the ink liquid from the ink outflow section and introducing air in the ink head from the downstream side in the introducing section into the introducing section, when the ink channel switching section is opened.

5. The sealing mechanism of the ink channel according to claim 4, wherein the ink channel switching section has a slidable switching lever, the switching lever has an ink sealing plug which seals the ink channel, and an open port which opens the ink channel, and the switching lever is slid to dispose one of the ink sealing plug and the open port on the ink channel.

6. The sealing mechanism of the ink channel according to claim 5, wherein the ink channel switching section has:

a switching housing through which the switching lever is extended in a state in which opposite end portions of the switching lever are protruded to the outside;

at least two support members which are disposed in the switching housing and which slidably support the switching lever; and at least two positioning sections which regulate a sliding range of the switching lever and which position one of the ink sealing plug and the open port on the ink channel.

7. The sealing mechanism of the ink channel according to claim 6, wherein the respective positioning sections are disposed on opposite sides of the switching lever, and the switching lever is slid in such a manner that the positioning sections abut on the switching housing to position one of the ink sealing plug and the open port on the ink channel.

8. The sealing mechanism of the ink channel according to claim 5, wherein the ink sealing plug has a sealing member which seals the ink channel.

9. The sealing mechanism of the ink channel according to claim 8, wherein the sealing member has an O-ring.

10. The sealing mechanism of the ink channel according to claim 4, wherein the ink head and the introducing section are integrated and disposed, and detachably attached to the ink outflow section, the switching lever of the ink channel switching section has an engaging member capable of engaging with the introducing section, and the engaging member is disposed on at least one end portion of the switching lever, and prevents the integrated ink head and introducing section from being detached from the ink outflow section in a state in which the engaging member engages with the introducing section.

11. The sealing mechanism of the ink channel according to claim 10, wherein the engaging member engages with the introducing section in a state in which the switching lever is slid to thereby position an open port of the switching lever on the ink channel.

12. The sealing mechanism of the ink channel according to claim 11, wherein the engaging member has a substantially hook shape.

13. The sealing mechanism of the ink channel according to claim 4, wherein the ink channel switching section has:

an ink sealing plug capable of fitting into the ink channel;

a retreating space which retreats the ink sealing plug; and a rotary mechanism which moves the ink sealing plug along a circular movement track between the ink channel and the retreating space.

14. The sealing mechanism of the ink channel according to claim 13, wherein the rotary mechanism has:

a rotary arm having a first end portion on which the ink sealing plug is disposed; and an ink path switching shaft which is disposed on a second end portion of the rotary arm and which rotatably supports the rotary arm.

15. The sealing mechanism of the ink channel according to claim 14, wherein the rotary arm is formed by an elastic member.

16. The sealing mechanism of the ink channel according to claim 13, wherein the ink sealing plug has:

a hemispherical plug body formed of a resin;

a sealing member which is disposed on a spherical surface of the plug body and which seals the ink channel.

17. The sealing mechanism of the ink channel according to claim 16, wherein the sealing member has an O-ring.

18. The sealing mechanism of the ink channel according to claim 16, wherein the ink sealing plug has a sealing member which seals the ink channel and which is formed into a hemispherical shape.

19. The sealing mechanism of the ink channel according to claim 4, wherein the ink outflow section has an outflow port out of which the ink liquid flows, and the outflow port has a port tilting with respect to an outflow direction of the ink liquid.

20. The sealing mechanism of the ink channel according to claim 19, wherein the outflow port has a shape such that surface tension in a film of air formed in the outflow port is set to be non-uniform on a surface of the film.

21. The sealing mechanism of the ink channel according to claim 19, wherein the ink outflow section is formed into a tubular shape, the outflow port tilts with respect to a direction of the tubular shape of the ink outflow section, and a section of the outflow port has an elliptic shape.

22. The sealing mechanism of the ink channel according to claim 19, wherein the outflow port has at least one cutout portion.

23. The sealing mechanism of the ink channel according to claim 4, wherein the ink outflow section has an outflow port tilted with respect to a tubular direction in which the ink liquid flows out, and wherein an uppermost portion of the tilt surface of the introducing section is disposed in such a manner as to match an upper portion of the outflow port in tilt.

24. The sealing mechanism of the ink channel according to claim 23, wherein the introducing section has a connection port disposed in the uppermost portion of the tilt surface, and the outflow port of the ink outflow section is fitted into the connection port.

* * * * *